US011400331B2

(12) United States Patent
Ryu et al.

(10) Patent No.: US 11,400,331 B2
(45) Date of Patent: Aug. 2, 2022

(54) METHOD FOR DETOXIFYING LIQUID CHEMICAL WARFARE AGENTS USING SURFACE-MODIFIED METAL ORGANIC FRAMEWORK

(71) Applicant: AGENCY FOR DEFENSE DEVELOPMENT, Daejeon (KR)

(72) Inventors: Sam-Gon Ryu, Daejeon (KR); Min-Kun Kim, Seoul (KR); Hyun-Sook Jung, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 374 days.

(21) Appl. No.: 16/603,899

(22) PCT Filed: Apr. 13, 2018

(86) PCT No.: PCT/KR2018/004336

§ 371 (c)(1),
(2) Date: Oct. 9, 2019

(87) PCT Pub. No.: WO2018/190671

PCT Pub. Date: Oct. 18, 2018

(65) Prior Publication Data

US 2020/0114189 A1 Apr. 16, 2020

(30) Foreign Application Priority Data

Apr. 13, 2017 (KR) ..... 10-2017-0047875

(51) Int. Cl.

| | |
|---|---|
| ***A62D 3/35*** | (2007.01) |
| ***A62D 3/34*** | (2007.01) |
| *A62D 101/02* | (2007.01) |
| *A62D 101/22* | (2007.01) |
| *A62D 101/26* | (2007.01) |
| *A62D 101/28* | (2007.01) |

(52) U.S. Cl.

CPC ..... *A62D 3/35* (2013.01); *A62D 3/34* (2013.01); *A62D 2101/02* (2013.01); *A62D 2101/22* (2013.01); *A62D 2101/26* (2013.01); *A62D 2101/28* (2013.01)

(58) Field of Classification Search

CPC ..... A62D 3/35; A62D 3/34; A62D 2101/02; A62D 2101/22; A62D 2101/26; A62D 2101/28

USPC ..... 588/317

See application file for complete search history.

(56) References Cited

U.S. PATENT DOCUMENTS

| | | | |
|---|---|---|---|
| 5,689,038 | A | 11/1997 | Bartram et al. |
| 6,537,382 | B1 | 3/2003 | Bartram et al. |
| 6,852,903 | B1 | 2/2005 | Brown et al. |
| 8,317,931 | B1 | 11/2012 | Wagner et al. |
| 8,530,719 | B1 | 9/2013 | Peterson et al. |
| 9,562,005 | B2 | 2/2017 | Bury et al. |

FOREIGN PATENT DOCUMENTS

| | | | |
|---|---|---|---|
| KR | 10-2010-0088619 | A | 8/2010 |
| KR | 10-2015-0051137 | A | 5/2015 |
| KR | 10-2016-0134644 | A | 11/2016 |
| KR | 10-1845661 | B1 | 4/2018 |

OTHER PUBLICATIONS

Moon, Su-Young et al., "Detoxification of Chemical Warfare Agents Using a Zr6-Based Metal-Organic Framework/Polymer Mixture", Chemistry A European Journal, 2016, vol. 22, pp. 14864-14868.

Search Report, dated Jul. 25, 2018, for International Application No. PCT/KR2018/004336.

Written Opinion, dated Jul. 25, 2018, for International Application No. PCT/KR2018/004336.

*Primary Examiner* — Edward M Johnson

(74) *Attorney, Agent, or Firm* — LRK Patent Law Firm

(57) ABSTRACT

A method of detoxifying a liquid chemical agent is provided using a surface-modified metal organic framework having an amine-based compound deposited on a surface and pores thereof, or bonded to the inside of a frame, wherein when the surface-modified metal organic framework comes into contact with the liquid chemical agent, a reaction with moisture in the atmosphere occurs and, the liquid chemical agent is removed through a hydrolysis reaction, thereby detoxifying chemical agents, such as nerve agents and vesicants, and assuring a high detoxification effect on liquid chemical agents at room temperature even with a small amount of the surface-modified metal organic framework.

5 Claims, 5 Drawing Sheets

METHOD FOR DETOXIFYING LIQUID CHEMICAL WARFARE AGENTS USING SURFACE-MODIFIED METAL ORGANIC FRAMEWORK

CROSS-REFERENCE TO RELAYED APPLICATIONS

The present application is a U.S. National Phase entry from International Application No. PCT/KR2018/004336, filed Apr. 13, 2018, which claims priority to Korean Patent Application No. 10-2017-0047875, filed Apr. 13, 2017, the disclosures of which are incorporated by reference herein in their entirety.

BACKGROUND

1. Technical Field

The present invention relates to a method of detoxifying a liquid chemical agent using a surface-modified metal organic framework having a detoxification effect for decomposing a toxic chemical agent present in a liquid state at room temperature into harmless substances which do not affect the living body to thus remove the chemical agent.

2. Description of Related Art

Exposure to toxic agents, including chemical agents used as war gases and industrial toxic substances, is a potential threat to both military personnel and civilians. The chemical agents used as war gases are still available in many countries, and some terrorist groups can easily make or obtain the same. Recently, the chemical agents have been used in the Middle East, Syria, etc., and cases of injury including civilians have been reported.

These chemical agents generally have the great potential to be sprayed in the form of fine aerosol fumes, so the chemical agents may be inhaled during breathing and also deposited on the surfaces of various military equipment and weapons, including military uniforms. Therefore, in order to minimize the risk of contact when the surfaces of the aforementioned devices are contaminated with highly toxic chemical agents, the toxic chemical agents must be removed promptly.

In particular, it is necessary to develop a technology for quickly removing an organophosphorus compound, which is a nerve agent, such as sarin (also called GB), soman (also called GD), and VN that is inhaled or penetrates the skin and acts on human and animal nervous systems to thus cause sudden paralysis and eventually lead to death in a short time, and distilled mustard (HD) which is a persistent blister agent.

In addition to the above-mentioned chemical agents, there is an increasing need for detoxification of industrial chemical substances. For example, the technology to effectively detoxify the surface contamination of precision equipment by insecticides that cause paralysis of the nervous system, that is, toxic substances including parathion, paraoxon, and malathion as organophosphorus pesticides, and various toxic substances not limited to organophosphoruses, which are used as a nerve agent, has become very important.

Currently, the most commonly used detoxicant against nerve agents in the world including the US military is a DS2 solution. DS2 has a composition of 2% by weight of sodium hydroxide (NaOH), 28% by weight of ethylene glycol monomethyl ether, and 70% by weight of diethylene triamine.

Although DS2 is an effective detoxicant to organophosphoruses which are nerve agents, DS2 is highly toxic, flammable, and strongly corrosive, and produces toxic byproducts during detoxification. Further, since diethylene triamine, which is a major component thereof, is known as a substance that causes malformation, it is likely to cause health hazards during use or production. Further, when the detoxification is performed using DS2, it is necessary to wash the surface to be detoxified using water after the detoxification in order to complete the detoxification process. Accordingly, the logistics burden is increased due to storage or transportation of large amounts of water in the detoxification place.

Another detoxicant currently in operation in the US military is a XE555 resin, which is used to rapidly detoxify surfaces contaminated with chemical agents. Although XE555 is effective in removing chemical agents, it has a drawback in that it does not have the ability to sufficiently neutralize the chemical agent of the absorbed toxicity, which may lead to the release of the vapor of toxic substances from the XE555 resin after the detoxification.

U.S. Pat. No. 6,852,903 discloses an alumina-based reactive adsorbent powder as an adsorbent having an enhanced reactivity. U.S. Pat. No. 5,689,038 discloses aluminum oxide or a mixture of aluminum oxide and magnesium monoperoxy phthalate (MMPP). Further, U.S. Pat. No. 6,537,382 discloses a metal-substituted zeolite adsorbent as a reactive adsorbent. The disclosed reactive adsorbents have merits in that the reactive adsorbents rapidly adsorb chemical agents or remove the toxicity of the adsorbed chemical agents, thereby preventing the chemical agents from being released from the adsorbents.

However, the reactive adsorbents have a common drawback in that the chemical agents contaminating the surface must be quickly absorbed or adsorbed to be removed, but the reaction speed for decomposing the adsorbed chemical agents is very slow.

In order to improve the slow reaction speed of the above-mentioned reactive adsorbents, U.S. Pat. No. 8,317,931 discloses nanotube-type titania to increase the speed of a reaction to detoxify VX. U.S. Pat. No. 8,530,719 discloses that zirconium hydroxide particles are used to dramatically increase the speed of a reaction to detoxify VX and GD. However, both cases have drawbacks in that the speed of the detoxification reaction of distilled mustard (HD), which is a blister agent, is significantly slower than that of VX or GD, which are nerve agents, and that there is a possibility that toxic substances may be released due to the insufficient adsorption ability thereof.

Therefore, when the nerve agent and the distilled mustard (HD), which is a blister agent, need to be sufficiently adsorbed at the same time in a short time and the detoxification reaction needs to be performed, there are still limitations. Accordingly, it is necessary to develop a detoxicant which is capable of simultaneously and rapidly adsorbing and detoxifying not only VX and GD, which are nerve agents, but also distilled mustard (HD).

SUMMARY

Technical Problem

The conventional detoxicants which have been used or reported have an ability to detoxify liquid chemical agents but have a problem of toxicity thereof. The detoxicants have an adsorption ability but no decomposition ability. The detoxicants have problems in that a decomposition reaction rate is very slow under an actual environmental condition at room temperature although adsorption and decomposition abilities are ensured and that the detoxicants do not have an ability to simultaneously detoxify various toxic chemical substances.

The present invention has been made keeping in mind the above problems, and an object of the present invention is to provide a method of detoxifying a liquid chemical agent. In the method, a surface-modified metal organic framework (MOF) which has a large specific surface area due to a metal-organic frame thereof and which manifests all catalytic characteristics using metal ions is used, thus decomposing all liquid toxic chemical substances, particularly liquid chemical agents, under various environmental conditions.

Technical Solution

A method of detoxifying a liquid chemical agent according to the present invention to accomplish the above object includes preparing a surface-modified metal organic framework (MOF) having a basic amine-based compound deposited on a surface thereof and in pores thereof or bonded to the inside of a frame, and bringing the metal organic framework having the surface modified through the preparing step into contact with the liquid chemical agent so that a decomposition reaction is performed to remove the liquid chemical agent, thereby achieving detoxification.

In the present specification, the liquid chemical agent means a chemical agent which is present in a liquid state at a room temperature of about 20 to 30° C., and is referred to as a chemical agent or a liquid chemical agent in the present invention.

The metal organic framework may include metal ions of one or more of zirconium (Zr), iron (Fe), titanium (Ti), copper (Cu), hafnium (Hf), vanadium (V), zinc (Zn), cobalt (Co), nickel (Ni), barium (Ba), calcium (Ca), strontium (Sr), niobium (Nb), chromium (Cr), tantalum (Ta), molybdenum (Mo), rubidium (Ru), osmium (Os), tungsten (W), manganese (Mn), rhenium (Re), palladium (Pd), platinum (Pt), silver (Ag), gold (Au), yttrium (Y), germanium (Ge), bismuth (Bi), arsenic (As), lead (Pb), indium (In), gallium (Ga), antimony (Sb), and a derivative thereof as a central metal.

Preferable examples of the metal organic framework may include MOF-808 ($Zr_6O_4(OH)_4(BTC)_2[HCOO]_6$), UiO-66 ($Zr_6O_4(OH)_4(BDC)_6$), UiO-66-$NH_2$ ($Zr_6O_4(OH)_4(BDC\text{-}NH_2)_6$), UiO-67 ($Zr_6O_6(BPDC)_{12}$), UiO-67-$NH_2$ ($Zr_6O_6(BPDC\text{-}NH_2)_{12}$), and MIL-100(Fe) (Acid-activated $Fe_3O(H_2O)_3F(BTC)_2$), but are not limited thereto, and various metal organic frameworks generally known to those skilled in the art may be used.

In the Chemical Formula showing the structure of the metal organic framework exemplified above, 'BDC' means 1,4-benzenedicarboxylate, 'BPDC' means 4,4'-biphenyldicarboxylate, and 'BTC' means 1,3,5-benzenetricarboxylate.

The basic amine-based compound deposited on a surface of the metal organic framework and in pores of the metal organic framework or bonded to the inside of the frame may be any one selected from among triethylenediamine (TEDA), triethylamine, quinuclidine, and pyridine-4-carboxylic acid, or a mixture thereof. It is particularly preferable to use triethylenediamine (TEDA).

The surface-modified metal organic framework contains the amine-based compound in a content of 6 to 20 wt % based on 100 wt % of the entire surface-modified metal organic framework.

When the content of the amine-based compound in the surface-modified metal organic framework is less than 6 we/o, since the content of the amine-based compound is low, the liquid chemical agent is not property decomposed, so that detoxification is impossible. On the contrary, when the amine-based compound is contained in a content of more than 20 wt % in the metal organic framework, since the specific surface area of the pores of the metal organic framework is reduced due to the increased amount of the amine-based compound, the reactivity for detoxifying the liquid chemical agent is reduced. Accordingly, it is preferable that the content of the amine-based compound in the surface-modified metal organic framework of the present invention satisfies the above-described range.

The metal organic framework having the surface modified through the preparation may be used in the form of powder and granules as a detoxicant for chemical agents, and the liquid chemical agent may be removed using a method, such as the detoxification, as will be described below.

The detoxification may include reacting the surface-modified metal organic framework with moisture in the atmosphere to thus remove the liquid chemical agent through a hydrolysis reaction, and the reaction may be performed for a reaction time of preferably 5 minutes to 4 hours.

When the reaction time of the detoxification is less than 5 minutes, the liquid chemical agent is not completely decomposed due to the short reaction time. When the reaction time is more than 4 hours, the decomposition effect of the liquid chemical agent may no longer be obtained and the detoxification time may be lengthened, thus reducing the reaction efficiency. The reaction time of the detoxification is not limited to the above-described range, but the reaction time may be appropriately changed as necessary.

In addition, the liquid chemical agent detoxified by the detoxification method of the present invention is any one selected from the group consisting of bis-(2-chloroethyl) sulfide, pinacolyl methylphosphonofluoridate, ethyl N,N-dimethylphosphoroamidocyanidate, isopropyl methylphosphonofluoridate, trichloronitromethane, O-ethyl S-(2-diisopropylamino)ethylmethylphosphonothioate, and a derivative thereof, or a mixture thereof.

Bis-(2-chloroethyl) sulfide has a molecular formula of $C_4H_8Cl_2S$, and is commonly referred to as distilled mustard or is referred to as HD as the abbreviation for NATO military standard (STANAG). Pinacolyl methylphosphonofluoridate has a molecular formula of $C_7H_{16}FO_2P$, and is commonly referred to as soman or is referred to as GD as the abbreviation for STANAG. Ethyl N,N-dimethylphosphoroamidocyanidate has a molecular formula of $C_5H_{11}N_2O_2P$, and is commonly referred to as tabun or is referred to as GA as the abbreviation for STANAG. Isopropyl methylphosphonofluoridate has a molecular formula of $C_4H_{10}FO_2$, and is commonly referred to as sarin or is referred to as GB as the abbreviation for STANAG. Trichloronitromethane has a molecular formula of $CCl_3NO_2$, and is commonly referred to as chloropicrin or is referred to as PS as the abbreviation for STANAG. O-ethyl S-(2-diisopropylamino)ethylmethylphosphonothioate has a molecular formula of $C_{11}H_{26}NO_2PS$, and is referred to as VX as the abbreviation for STANAG.

The liquid chemical agents used in the present specification are referred to as the above common names or the abbreviation for NATO military standard (STANAG).

Advantageous Effects

Through the above-described solution means, in the present invention, a surface-modified metal organic framework is used, which is obtained by depositing a basic amine-based compound on the surface and in pores of a metal organic framework that has a large specific surface area due to mesopores having a relatively large pore size and is stable to moisture, heat, and chemical substances, or by bonding the basic amine-based compound to the inside of a frame. Accordingly, the efficiency of detoxifying sarin (GB), soman (GD), and VX as a nerve agent, which is a hydrophilic chemical agent, and distilled mustard (HD) as a blister agent, which is a hydrophobic chemical agent, among the liquid chemical agents is greatly increased.

Therefore, an ability to simultaneously detoxify a nerve agent and a vesicant, which is not assured by conventional detoxicants, is assured using the detoxification method according to the present invention, and the high detoxification efficiency on a chemical agent that is in a liquid state at room temperature is assured. Accordingly, the effect that is equivalent to and better than that of a conventional detoxicant is assured even when using a small amount of the surface-modified metal organic framework. Further, it can be applied to protective cloth and protective dress for chemical agent protection and thus can be widely used for military and business purposes.

DETAILED DESCRIPTION OF THE INVENTION

Figure 1:
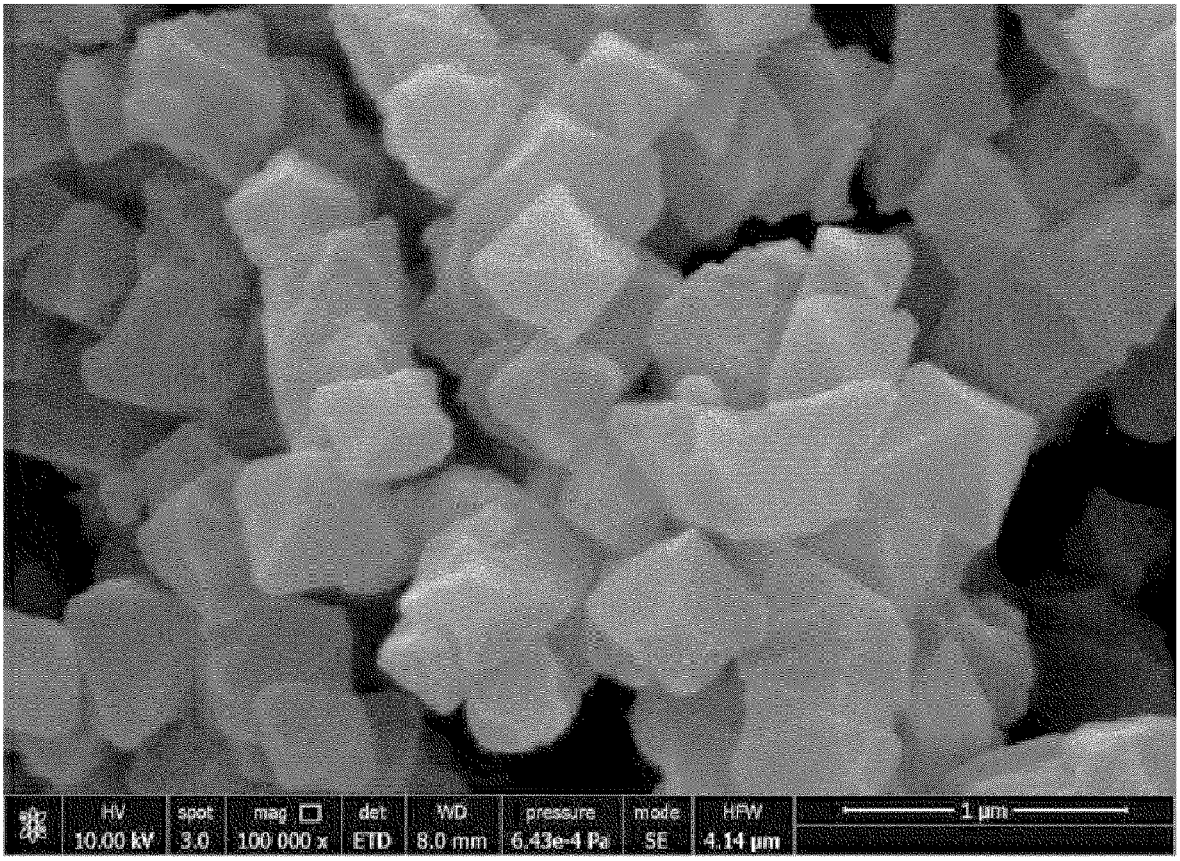
FIG. 1 is a photograph showing the surface state of a surface-modified metal organic framework manufactured in an Example of the present invention observed using a scanning electron microscope (SEM)

The technical terms used herein should be construed in a sense generally understood by a person having ordinary skill in the art to which the present invention belongs unless defined otherwise in the present invention, and should not be construed in an overly broad sense or an overly reduced sense. In addition, the general terms used in the present invention should be construed as defined in a dictionary or according to the context.

Hereinafter, a method of detoxifying a toxic substance to be carried out in the present invention will be described in detail with reference to the accompanying drawings and Examples.

A surface-modified metal organic framework of the present invention is manufactured by depositing triethylenediamine (TEDA) as a basic amine-based compound in pores of a metal organic framework that is referred to as MOF-808 and UiO-66 using the method as will be described below.

The manufacturing conditions such as the rotation speed, the rotation time, the temperature, the drying temperature, and the drying time suggested in a method of manufacturing a surface-modified metal organic framework according to the present invention as will be described below are experimentally obtained through repeated experiments for finding the optimal conditions, and are considered to be optimal for the purpose of the present invention.

Example 1 is a method of manufacturing a surface-modified metal organic framework. Before triethylenediamine (TEDA) which is a basic amine-based compound is deposited on a metal organic framework, pulverization using an agate mortar or a ball mill method is applied in order to facilitate adsorption in pores of the metal organic framework, so that a particle size is as small as possible, namely 1 μm or less, thereby achieving preparation. In the case of the ball mill method, balls and metal organic framework particles are mixed at a volume ratio of at least 1:1 to at most 3:1. A ball milling time is at least 1 minute to at most 1 hour and preferably 5 minutes to 30 minutes, and triethylenediamine (TEDA) particles are pulverized at a rotation speed of 30 to 300 rpm.

Next, the surface of the metal organic framework is reformed with the prepared triethylenediamine (TEDA) using a rotary evaporation method. Specifically, MOF-808 powder, which is the metal organic framework, and the prepared triethylenediamine (TEDA) powder, which is an amine-based compound, are added together to a flask vessel of a rotary evaporator. An external thermostat or an oven is used so that the temperature of the inside of the flask is maintained at least 50° C. to at most 180° C. under an atmospheric pressure condition, and triethylenediamine (TEDA), which is the amine-based compound, is deposited by sublimation in the pores and on the surface of MOF-808 at a rotation speed of 10 to 120 rpm and preferably 30 to 80 rpm under normal pressure for about 2 to 24 hours. Triethylenediamine (TEDA) is deposited in a content of 6 wt %.

In Examples 2 to 4, the surface-modified metal organic framework is manufactured using the same rotary evaporation method as in Example 1, except that the amount of triethylenediamine (TEDA) deposited in the pores and on the surface of MOF-808 is changed. Triethylenediamine (TEDA) is deposited in an amount of 10 wt % (Example 2), 15 wt % (Example 3), and 20 wt % (Example 4).

In the present Example, triethylenediamine (TEDA), which is a basic amine-based compound, is deposited in the pores and on the surface of MOF-808, which is the metal organic framework, to obtain the surface-modified metal organic framework, and this surface-modified metal organic framework is referred to as 'MOF-808-TEDA'. The deposition amount is given after the MOF-808-TEDA expression according to the deposition amount of triethylenediamine (TEDA). For example, MOF-808-TEDA is named in the form of MOF-808-TEDA 6 wt %, MOF-808-TEDA 10 wt %, MOF-808-TEDA 15 wt %, and MOF-808-TEDA 20 wt %.

FIG. 1 shows an image observed using a scanning electron microscope (SEM) in order to confirm the surface state and the particle diameter of the surface-modified metal organic framework obtained by depositing triethylenediamine (TEDA) on the surface of MOF-808, which is the metal organic framework, through Example 4. FIG. 1 shows that, after the triethylenediamine deposition treatment, triethylenediamine and related compounds thereof are not aggregated on the surface of the metal organic framework and do not wrap the surface thereof, which indicates that triethylenediamine and the related compounds thereof are evenly diffused and thus deposited into the pores.

Figure 2:
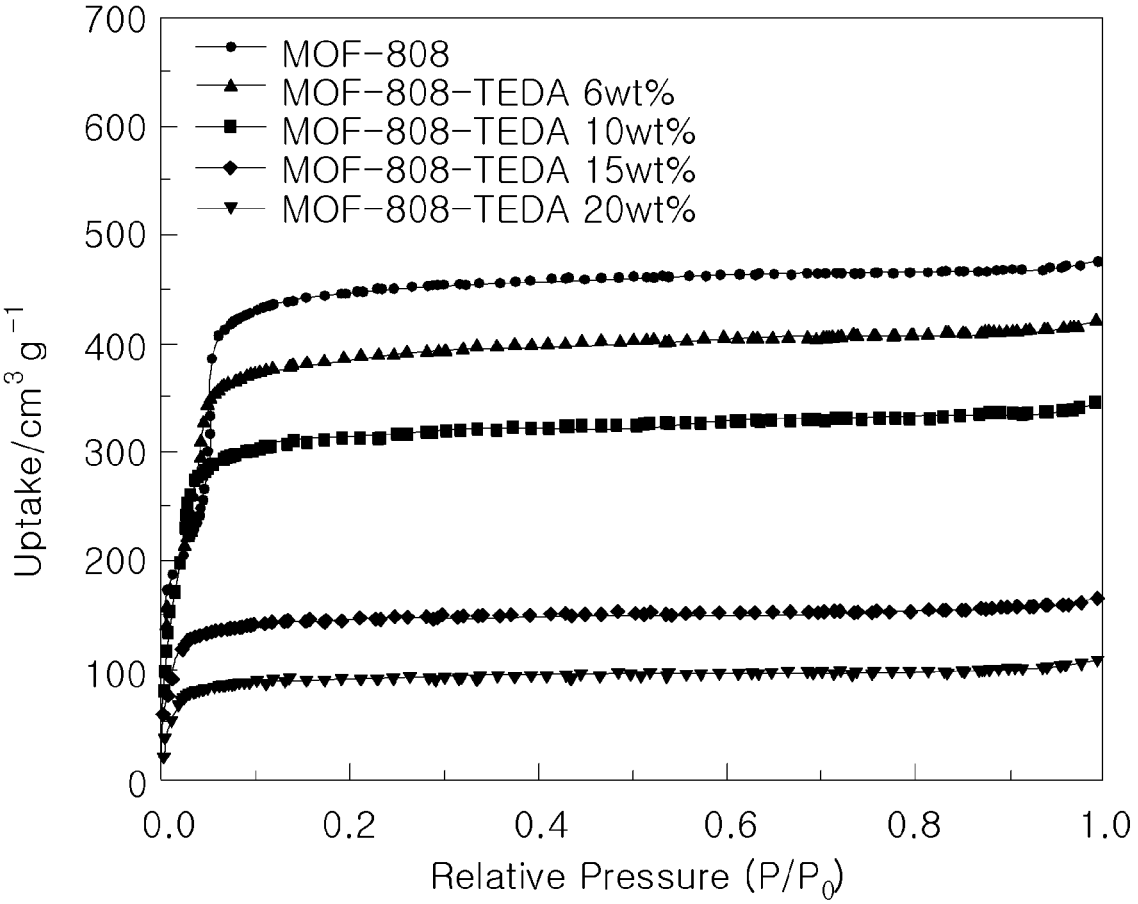
FIG. 2 is a comparative analysis graph of a nitrogen adsorption curve of the surface-modified metal organic framework manufactured in the Example of the present invention.

FIG. 2 shows the results of measurement of nitrogen adsorption isotherms of the surface-modified metal organic frameworks according to Examples 1 to 4 and MOF-808, which is the metal organic framework before surface reforming. In each of the Examples, in order to measure the surface area of the surface-modified metal organic framework, the boiling point of liquid nitrogen at −196° C. and the physical adsorption amount of nitrogen at 1 atm or less were measured to thus obtain the nitrogen adsorption isotherm. The BET equation was applied to the measured adsorption isotherm, thus measuring the value of the BET surface area per unit weight ($cm^3/g$) before and after triethylenediamine (TEDA) was deposited on the metal organic framework.

As a result, as shown in FIG. 2, the specific surface area is changed according to the deposition ratio of triethylenediamine (TEDA), but until the deposition rate of triethylenediamine (TEDA) reaches 10 wt %, a reduction in specific surface area is not large compared to MOF-808 before the surface reforming.

Figure 3:
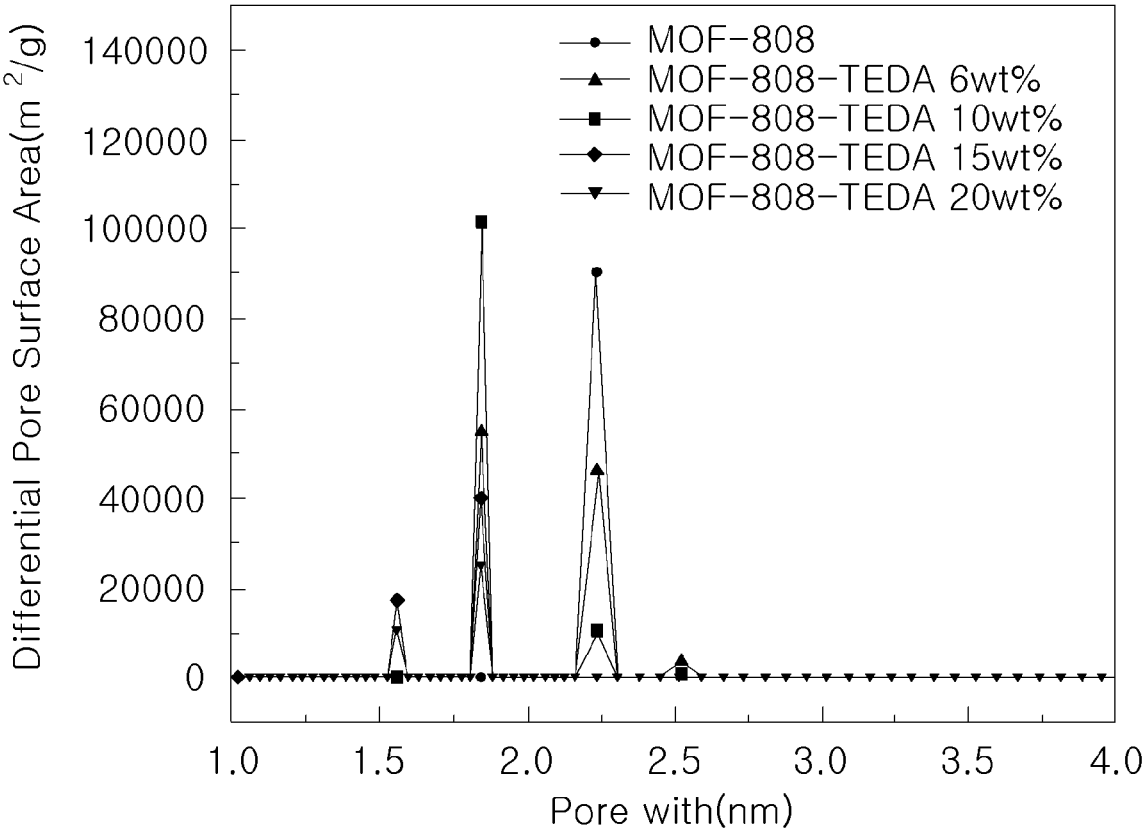
FIG. 3 is a graph showing the analysis of change in pore distribution of the surface-modified metal organic framework manufactured in the Example of the present invention.

FIG. 3 shows the pore size distributions of the surface-modified metal organic frameworks according to Examples 1 to 4. It can be confirmed that MOF-808-TEDA 15 wt % of Example 3, in which the deposition ratio of triethylenediamine (TEDA) is 15 wt % or more, and MOF-808-TEDA 20 wt % of Example 4 have micropores having a pore diameter of 2 nm or less. However, it can be confirmed that MOF-808-TEDA 6 wt % of Example 1 and MOF-808-TEDA 10 wt % of Example 2 have mesopores having a pore diameter of about 2.25 nm and 2.5 nm, which is in the range of 2 to 50 nm. The pore diameters are classified according to the definition of IUPAC (International Union of Pure and Applied Chemistry).

Figure 4:
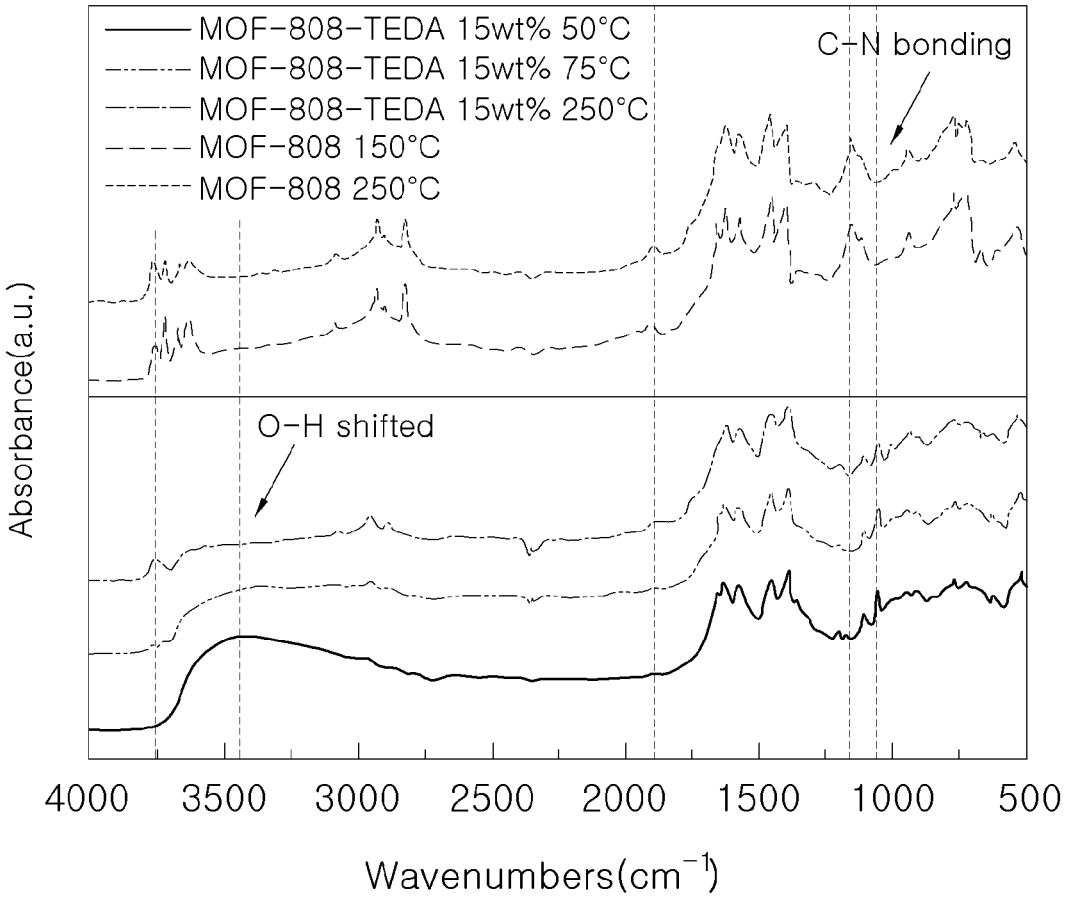
FIG. 4 shows an analysis curve of Fourier transform infrared spectroscopy (FT-IR) of the surface-modified metal organic framework manufactured in the Example of the present invention.

FIG. 4 shows the analysis spectrum of an infrared absorption spectrometry (FT-IR, Fourier transform infrared) of MOF-808-TEDA 15 wt % of Example 3 depending on the deposition temperature. As shown in FIG. 4, even when triethylenediamine (TEDA) is deposited at a temperature of 250° C., the OH peak caused by triethylenediamine (TEDA) remains, indicating that triethylenediamine (TEDA) is strongly deposited on the metal organic framework and thus is not easily separated therefrom by heat.

In order to confirm the decomposition effect of the liquid chemical agent by the surface-modified metal organic framework according to the present invention, the decomposition evaluation experiment for each toxic substance as will be described below was performed as in the following Experimental Examples 1 to 4.

In Experimental Example 1, 10 mg of reactive material powder or particles was added to a 2.0 mL glass vial, and a solution, in which 0.4 μl of distilled mustard (HD) or GD (also called soman') as the liquid chemical agent and 20 μl of pentane were mixed, was injected using a micro-syringe, followed by mixing for 5 minutes using a voltex mixer so that the chemical agent was uniformly adsorbed or impregnated sufficiently in each material. Next, after storage at room temperature of about 20 to 30° C. for a predetermined time, 1.5 ml of ethyl acetate was added to each glass vial, followed by shaking at a temperature of 25° C. for 2 hours. Subsequently, the content in the vial was filtered using a syringe filter, and the decomposition rate of HD or GD as the liquid chemical agent was measured using the filtered solution according to gas chromatography-mass spectrometry.

MOF-808-TEDA 6 wt % which was the surface-modified metal organic framework according to Example 1 of the present invention was used as the reactive material used in Experimental Example 1. In order to compare decomposition efficiencies of the liquid chemical agent by the above-described reactive material and a conventional reactive material, the decomposition rate of HD or GD was measured in the same manner as in Experimental Example 1 using commercially available zirconium hydroxide ($Zr(OH)_4$) manufactured by Aldich Company, UiO-66 and MOF-808 which were the metal organic framework having no modified surface, and UiO-66-$NH_2$ in which an amine group ($NH_2$) was bonded to UiO-66.

Further, the storage method before adding ethyl acetate depends on the type of liquid chemical agents used in Experimental Example 1. For example, in the case of measurement of the decomposition rate of HD, storage was performed in an atmospheric environment at room temperature of about 20 to 30° C. and relative humidity of 30 to 70% for 24 hours before the use. In the case of measurement of the removal rate of GD, storage was performed in a vacuum desiccator at room temperature and relative humidity of 30 to 70% for 24 hours before the use.

In Experimental Example 1, the results of measurement of the decomposition rates of GD and distilled mustard (HD), which are the liquid chemical agent, for each reactive material are shown in the following Tables 1 and 2, respectively. The GD decomposition rate is a decomposition rate obtained by reacting the reactive material and GD for 5 minutes, followed by measurement. The HD decomposition rate is a decomposition rate obtained by reacting the reactive material and HD for 4 minutes, followed by measurement. The case in which the decomposition rate of the liquid chemical agent is 100% indicates that the chemical agent is decomposed to a concentration that does not affect the living body.

TABLE 1

| Sample | $Zr(OH)_4$ | UiO-66 | UiO-66-$NH_2$ | MOF-808 | MOF-808-TEDA 6 wt % |
|---|---|---|---|---|---|
| GD decomposition rate (%) | 82 | 78 | 75 | 83 | 100 |

TABLE 2

| Sample | $Zr(OH)_4$ | UiO-66 | UiO-66-$NH_2$ | MOF-808 | MOF-808-TEDA 6 wt % |
|---|---|---|---|---|---|
| HD decomposition rate (%) | 85 | 30 | 100 | 55 | 100 |

As shown in Tables 1 and 2, in the case of MOF-808-TEDA 6 wt % having a surface modified by depositing triethylenediamine (TEDA), which is an amine-based compound, both the GD decomposition rate and the HD decomposition rate are 100%, indicating that perfect decomposition occurred.

In the case of UiO-66-$NH_2$ to which an amine group ($NH_2$) is bonded, the GD decomposition rate is 75%, which is slightly lower than 78% of the GD decomposition rate of UiO-66 which is a general metal organic framework. However, the HD decomposition rate is exhibited to be 100%, indicating that the HD decomposition rate is significantly increased compared to samples of commercially available zirconium hydroxide ($Zr(OH)_4$), whose surface is not modified with an amine-based compound, and UiO-66 and MOF-808 which are a general metal organic framework.

Further, although the reaction time of the detoxification is short, namely 5 minutes, the GD decomposition rate is 100% in the case of MOF-808-1EDA 6 wt %, indicating that the detoxification method of the present invention is useful to decompose the liquid chemical agent in a short time.

In Experimental Example 2, in order to confirm a change in decomposition rate of the chemical agent depending on moisture, the experiment was performed in the same manner as in Experimental Example 1. However, after reactive materials, which were samples used in the experiment, were pretreated under dry and humid conditions, the decomposition rate of distilled mustard (HD) was confirmed, and a reaction time was 1 hour. For the pretreatment condition, a dry sample was used after being stored in a vacuum desiccator for 24 hours or more. On the contrary, a humidity-treated sample was treated in a convection oven at about 25° C. under a relative humidity condition of 60% for 24 hours, and the decomposition rate of distilled mustard (HD) was then measured. The result of Example 2 is shown in Table 3.

TABLE 3

| Sample | Dry sample HD decomposition rate (%) | Humidity-treated sample HD decomposition rate (%) |
|---|---|---|
| MOF-808 | 1.1 | 34.6 |
| MOF-808-TEDA 6 wt % | 6.4 | 54.1 |
| UiO-66 | 2.6 | 18.4 |
| UiO-66-$NH_2$ | 19.4 | 81.5 |
| UiO-66-TEDA 6 wt % | 0.6 | 15.7 |
| $Zr(OH)_4$ | 87.4 | 17.8 |
| $Zr(OH)_4$-TEDA 6 wt % | 18.3 | 1.8 |
| Cu-BTC | 0 | 47.3 |

From the result shown in Table 3, it can be confirmed that the HD decomposition rate of zirconium hydroxide ($Zr(OH)_4$) in the sample under the dry condition was highest 87.4%. However, the decomposition rate was 17.8% in the case of the humidity-treated sample, and a rapid reduction in decomposition rate can be confirmed. This result shows that zirconium hydroxide ($Zr(OH)_4$) does not effectively decompose HD due to moisture in the atmosphere. However, it can be confirmed that, in the case of all humidity-treated samples other than zirconium hydroxide ($Zr(OH)_4$), the decomposition rate is increased compared to that in the case of the dry samples. Moreover, it can be confirmed that, in the cases of MOF-808-TEDA 6 wt % in which TEDA is deposited and UiO-66-$NH_2$ in which an amine group ($NH_2$) is bonded to the frame, the HD decomposition rate is greatly increased compared to that in the case of other samples.

In general, the metal organic framework (MOF) has a drawback in that the structure of the metal organic framework is destroyed when it comes into contact with moisture, and thus there are many limitations in application such as minimizing contact with moisture in the atmosphere. On the contrary, as described above, in the case of the surface-modified metal organic framework of the present invention, the decomposition rate of the liquid chemical agent is increased due to moisture in the atmosphere.

Although the result of confirmation of the products decomposed from the resultant extracts of the experiments of Experimental Example 1 and Experimental Example 2 using a gas chromatography-mass spectrometer (GC-MSD) is not shown in the drawings of the present invention, the hydrolysis reaction products of both GD and HD were confirmed. Specifically, in the case of GD, it was confirmed that isopropyl methyl organophosphates (isopropyl methyl phosphonic acid) were generated as the hydrolysis product. In the case of HD, it could be confirmed that 2-chloroethyl 2-hydroxyethylsulfide and dithioglycol (DTG) were generated as the hydrolysis products and 2-chloroethyl vinyl sulfide was generated due to a dehydrohalogenation reaction.

Therefore, in the detoxification method of the present invention, it can be seen that the surface-modified metal organic framework is reacted with moisture in the atmosphere to decompose the liquid chemical agent through a hydrolysis reaction.

Experimental Example 3 relates to a dynamic decomposition measurement experiment of distilled mustard (HD) for each reactive material. As the reactive material used herein, MOF-808-TEDA 6 wt %, which was the surface-modified metal organic framework according to Example 1, was used. For the purpose of comparison of the HD decomposition efficiency thereof, commercially available zirconium hydroxide ($Zr(OH)_4$), MOF-808 which was the metal organic framework having no modified surface, and UiO-66-$NH_2$ in which an amine group ($NH_2$) was bonded to UiO-66 were used to measure the dynamic decomposition rate of HD according to the following method.

Specifically, in Experimental Example 3, in order to perform the decomposition experiment of HD as a first experiment, first, 10 mg of reactive material powder or particles, which were a sample, was added to the middle of a glass tube, and both ends thereof were supported by glass wool. 10 of HD was injected into the middle of glass wool at an inlet side of a carrier gas flow using a micro-syringe. The glass tube into which the reactive material and HD were injected was equipped in a thermostat chamber connected to a gas chromatography-mass spectrometer (GC-MSD) in situ. Helium (He) was allowed to flow at a flow rate of 30 ml/min and a temperature of 32° C., and gas samples automatically sampled at regular intervals of time at the outlet of the glass tube were analyzed using the gas chromatography-mass spectrometer (GC-MSD) to thus confirm the amount of HD released after passing through a reactive material layer. In the case of second and third HD injections, the glass tube charged with the reactive material used in the first experiment was continuously used, and 1 μl of HD was injected thereinto, thus confirming the maximum adsorption and decomposition abilities of the reactive material. The result is shown in FIG. 5.

Figure 5:
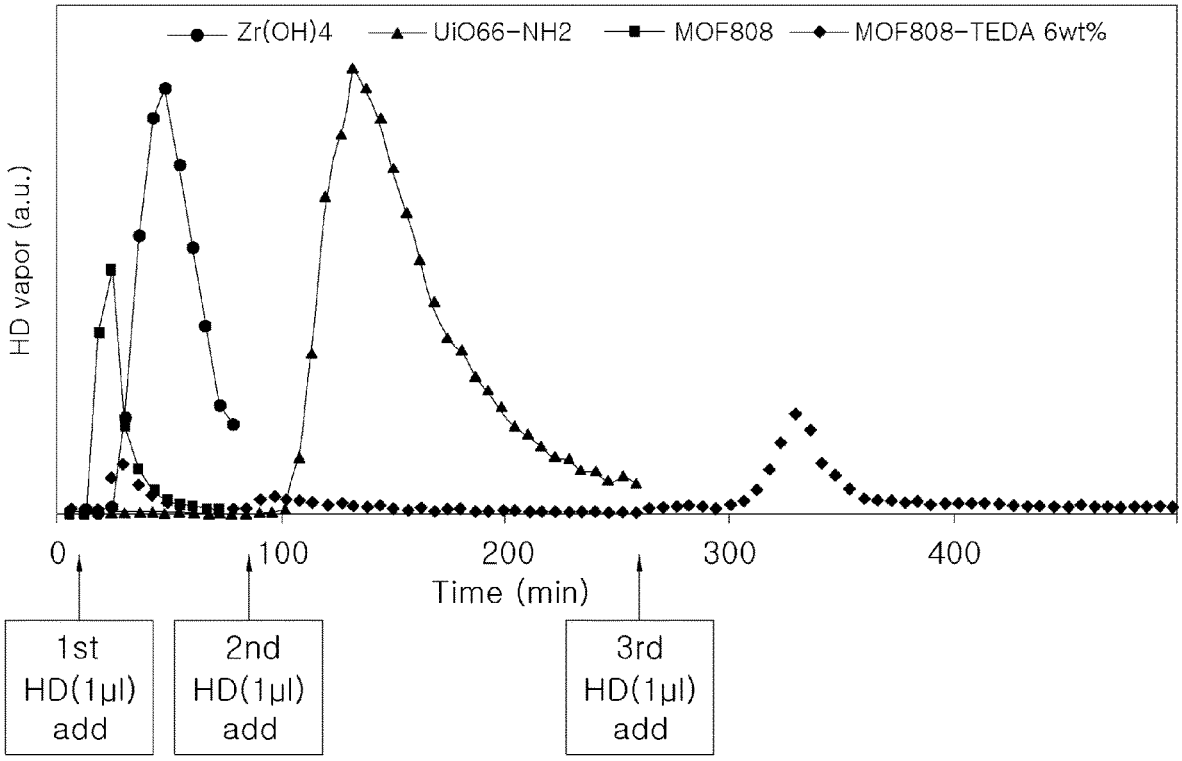
FIG. 5 is a graph showing adsorption and removal efficiencies of distilled mustard (HD) by a dynamic experiment.

As shown in FIG. 5, in the case of zirconium hydroxide ($Zr(OH)_4$) and MOF-808 which was a general metal organic framework, the very large amount of HD was released after passing through the adsorption tube immediately after the first injection of 10 of HD. After the second injection of 10 of HD, HD, which had been not released in the first injection, was released in the case of UiO-66-$NH_2$. In the case of MOF-808-TEDA 6 wt %, it was confirmed that HD was released after the third injection of 1 μl of HD but the release amount thereof was significantly lower than that in the case of zirconium hydroxide ($Zr(OH)_4$) or UiO-66-$NH_2$. That is, it is judged that MOF-808-TEDA 6 wt % exhibits the HD adsorption and decomposition efficiencies three times higher than those in the case of zirconium hydroxide ($Zr(OH)_4$) and that UiO-66-$NH_2$ exhibits the HD adsorption and decomposition efficiencies twice higher than those in the case of zirconium hydroxide ($Zr(OH)_4$).

As described above, since the present invention significantly improves the decomposition efficiency of nerve agents, such as GD, and HD as blister agents among liquid chemical agents, it is possible to simultaneously detoxify a hydrophilic chemical agent and a hydrophobic chemical agent unlike conventional detoxifying materials.

The above description is a preferred embodiment given so that those skilled in the art can readily implement the present invention, but is not limited to the disclosed embodiments and the accompanying drawings, and thus the scope of the present invention is not limited thereto. Therefore, it is to be understood that various substitutions, changes, and modifications can be made therein without departing from the spirit of the present invention and that those parts equivalent thereto are included in the scope of the present invention.

The invention claimed is:

1. A method of detoxifying a liquid chemical agent using a surface-modified metal organic framework, the method comprising:

preparing the surface-modified metal organic framework having an amine-based compound deposited on a surface and pores thereof, or bonded to an inside of a frame, wherein the amine-based compound is triethylenediamine; and bringing the surface-modified metal organic framework into contact with the liquid chemical agent so that a decomposition reaction is performed to remove the liquid chemical agent, thereby achieving detoxification, wherein the surface-modified metal organic framework contains 6 to 20 wt % of the amine-based compound based on 100 wt % of the entire surface-modified metal organic framework.

2. The method of claim 1, wherein the liquid chemical agent is any one selected from the group consisting of bis-(2-chloroethyl) sulfide, pinacolyl methylphosphonofluoridate, ethyl N,N-dimethylphosphoroamidocyanidate, isopropyl methylphosphonofluoridate, trichloronitromethane, O-ethyl S -(2-diisopropylamino)ethylmethylphosphonothioate, and a derivative thereof, or a mixture thereof.

3. The method of claim 1, wherein the metal organic framework includes metal ions of one or more of zirconium (Zr), iron (Fe), titanium (Ti), copper (Cu), hafnium (Hf), vanadium (V), zinc (Zn), cobalt (Co), nickel (Ni), barium (Ba), calcium (Ca), strontium (Sr), niobium (Nb), chromium (Cr), tantalum (Ta), molybdenum (Mo), rubidium (Ru), osmium (Os), tungsten (W), manganese (Mn), rhenium (Re), palladium (Pd), platinum (Pt), silver (Ag), gold (Au), yttrium (Y), germanium (Ge), bismuth (Bi), arsenic (As), lead (Pb), indium (In), gallium (Ga), antimony (Sb), and a derivative thereof as a central metal.

4. The method of claim 3, wherein the metal organic framework is any one selected from among MOF-808, UiO-66, UiO-66-$NH_2$, UiO-67, UiO-67-$NH_2$, and MIL-100 (Fe).

5. The method of claim 1, wherein the detoxification includes reacting the surface-modified metal organic framework with moisture in an atmosphere for a reaction time of 5 minutes to 4 hours to thus remove the liquid chemical agent through a hydrolysis reaction.

* * * * *